United States Patent [19]

Signoretto

[11] Patent Number: 5,071,112

[45] Date of Patent: Dec. 10, 1991

[54] APPARATUS FOR SUPERPOSING PIECES OF PHOTOGRAPHIC FILM

[76] Inventor: Roberto Signoretto, Via Dosa, 1, 30030 - Olmo Di Martellago, Venezia, Italy

[21] Appl. No.: 531,792

[22] Filed: May 24, 1990

Related U.S. Application Data

[63] Continuation of Ser. No. 266,064, Nov. 2, 1988, abandoned.

[30] Foreign Application Priority Data

Nov. 6, 1987 [IT] Italy ..... 84170 A/87

[51] Int. Cl.[5] ..... B65H 29/46

[52] U.S. Cl. ..... 271/180; 271/176; 271/189; 414/790.3; 414/790.8

[58] Field of Search ..... 414/790.3, 790.8; 271/180, 181, 189, 192, 176

[56] References Cited

U.S. PATENT DOCUMENTS

| | | | |
|---|---|---|---|
| 2,595,346 | 5/1952 | Federwitz | 271/180 |
| 2,702,190 | 2/1955 | Welsh | 271/181 |
| 4,290,594 | 9/1981 | Ludemann | 271/180 |
| 4,512,263 | 4/1985 | Lanning | 271/181 |
| 4,716,711 | 1/1988 | Signoretto . | |
| 4,779,122 | 10/1988 | Signoretto . | |
| 4,800,406 | 1/1989 | Signoretto . | |
| 4,881,090 | 11/1914 | Signoretto . | |
| 4,932,189 | 6/1990 | Signoretto . | |
| 4,973,035 | 11/1990 | Signoretto . | |

FOREIGN PATENT DOCUMENTS

| | | | |
|---|---|---|---|
| 1951506 | 11/1977 | Fed. Rep. of Germany | 271/192 |
| 58494 | 5/1979 | Japan | 271/180 |

*Primary Examiner*—Richard A. Schacher

*Attorney, Agent, or Firm*—Hoffman, Wasson & Gitler

[57] ABSTRACT

A device for superposing pieces of strip material, particularly pieces of photographic film, characterized by comprising a pair of horizontal guides (9) comprising two parallel superposed flanges defining a channel for the passage of the pieces (29) of strip material, and further characterized in that said guides have their lower flange (10) outwardly displaceable to enable said pieces (29) to fall onto an underlying stacking magazine, and then returnable to its operating position to reconstitute the guide path for the next piece, and at the same time to upperly retain the forming stack of pieces in correspondence with its edges, with said guides (9) there being associated at least one vertically acting pusher (23) for retaining the forming stack of pieces (29) when the lower flange (10) of the guides (9) is in its displaced position, and a horizontally acting pusher (24) for transferring said stack of pieces (29) out of said stacking magazine.

9 Claims, 2 Drawing Sheets

APPARATUS FOR SUPERPOSING PIECES OF PHOTOGRAPHIC FILM

Figure 1:
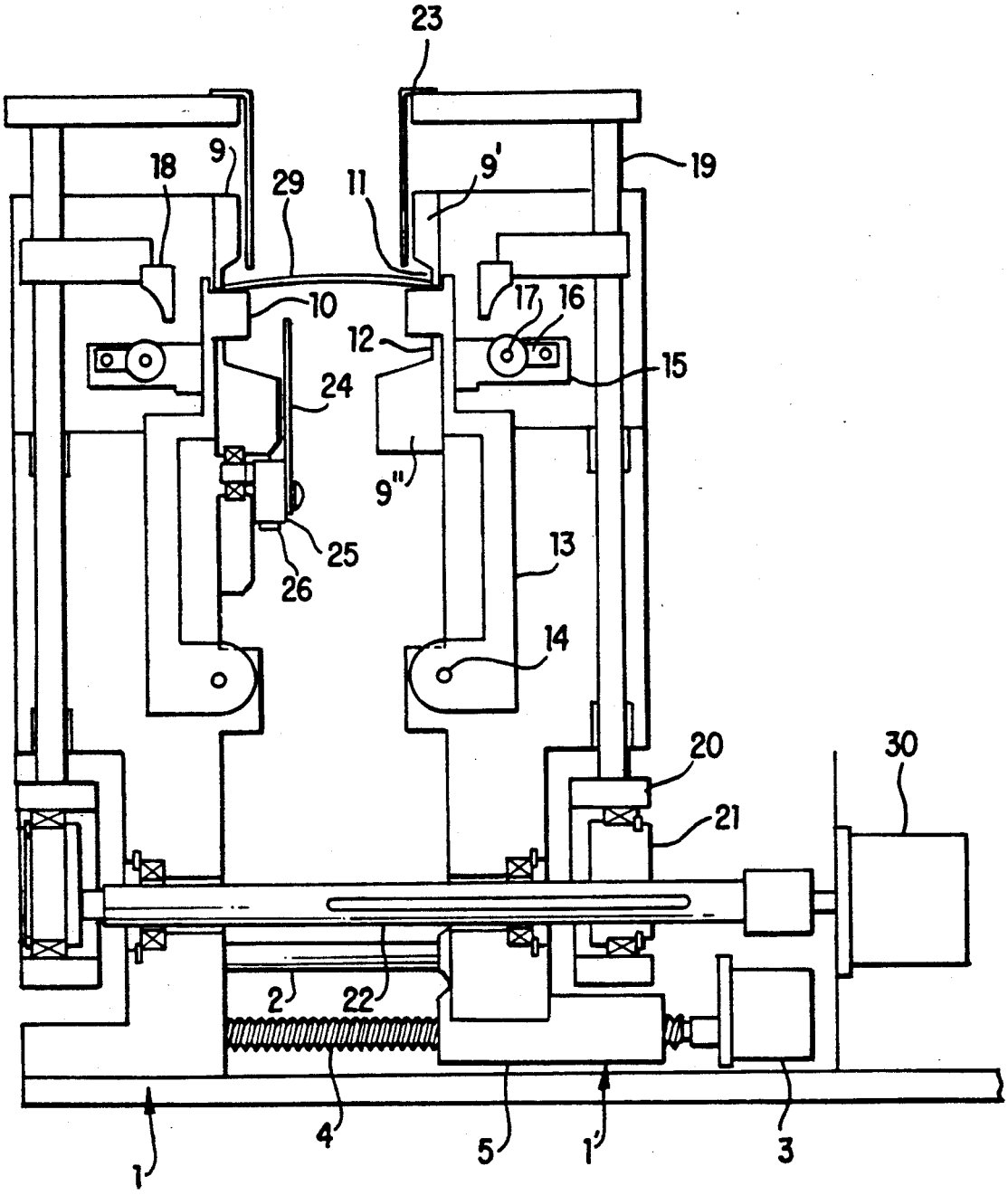

This application is a continuation of copending application Ser. No. 266,064, filed Nov. 2, 1988 now abandoned.

This invention relates to a device for superposing pieces of strip material particularly pieces of photographic film.

The various operations which film undergoes during its handling cycle in photographic laboratories includes one in which after the printing stage the continuous strip of negatives is cut into pieces which for correct insertion into the wallet or envelope in which they are returned to the customer must be previously stacked on each other. This is done by feeding the individual film pieces leaving the cutter to a superposing station in which they are stacked on each other to form a pack.

Because the particular nature of the handled material, these operations suffer from a series of problems particularly concerning the superposing of the pieces, these problems so far not having been satisfactorily solved.

For superposing the pieces when cut to size, a device is known comprising two pairs of vertically overlying guides, namely an upper pair representing an extension of the feed path for the pieces arriving from the cutter, and a lower pair forming the magazine for the superposed pieces. The two upper guides can be tilted inwardly downwards to facilitate the action of two pressers which downwardly press the piece positioned between the two tilted guides, to deform it by the amount necessary to separate it from these guides and position it on the pieces already stacked between the two lower guides, from which finally the entire pack of pieces is transferred into the wallet.

The drawback of this method is that the tilting of the two upper guides which retain the piece and the action of the pushers which separate it from these guides deform the actual piece, this deformation being greater the thinner the film.

For unhindered translatory movement of the pieces this deformation presupposes that they have uniform yieldability in the transverse direction, and this may not happen in practice, especially if the negative has a plastic or paper tab applied along a longitudinal edge for annotations relating to any reordering by the final customer.

An object of the invention is to obviate these drawbacks by effecting the superposing of the pieces of photographic film in a simple manner by means of a reliable device and in particular without even minimally damaging the film frames during their transfer from the cutter to the wallet.

This and further objects, which will be apparent from the description given hereinafter, are attained according to the invention by a device for superposing pieces of strip material, comprising a pair of horizontal guides, each comprising at least two parallel superposed flanges defining a channel for the passage of the pieces of strip material. In each guide, one of the flanges is outwardly displaceable, to enable the strip material to fall onto an underlying stacking magazine, and then returnable to its initial position to reconstitute the guide path for the next piece, and at the same time to upperly retain the forming stack of pieces in correspondence with its edges. The guides are associated with at least one vertically acting pusher for retaining the forming stack of pieces when the lower flange of the guides is in its displaced position, and a horizontally acting pusher for transferring said stack of pieces out of said stacking magazine.

Figure 2:
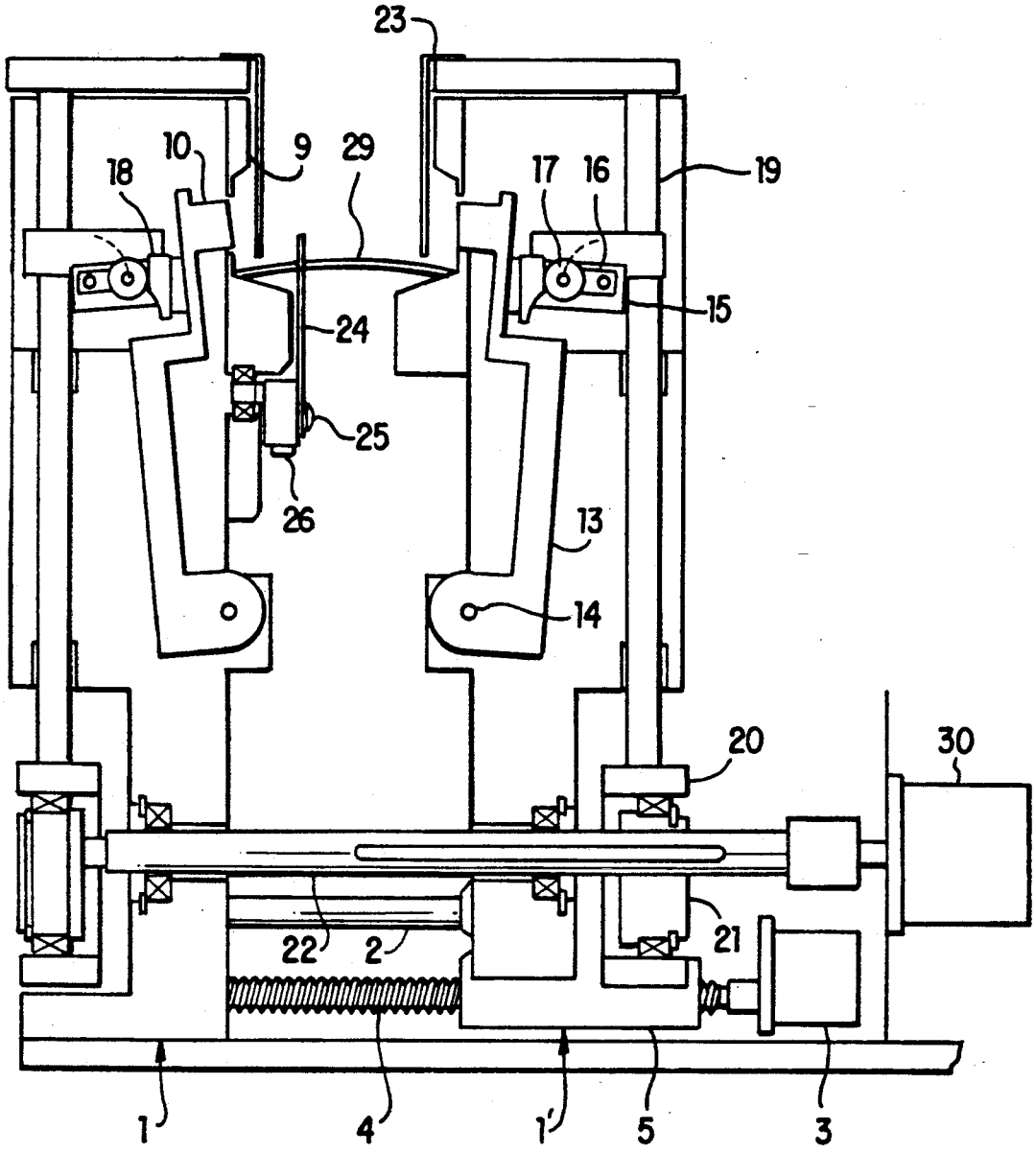

The present invention is described in detail hereinafter with reference to the accompanying drawings in which:

FIG. 1 is a vertical cross-section though a superposing device according to the invention; and FIG. 2 shows it in the same view as FIG. 1 but with the terminal portion of the guide in an outwardly yielded position.

As can be seen in the drawings, the device according to the invention, which is positioned downstream of a traditional cutter for photographic film pieces, i.e. an apparatus which automatically cuts a continuous film into pieces of length suitable for insertion into conventional wallets of standard dimensions, comprises two units 1,1', the first being fixed and the second being withdrawable from the first for adapting the assembly to the different commercially available film widths. This is done by mounting the first unit 1 rigid with an overall frame and the second unit 1' slidable, driven by an electric motor 3 by way of a system comprising a mutually engaged screw 4 and lead nut 5, along two transverse guides 2 rigid with said frame.

The first unit 1 also comprises a belt conveying system (not shown on the drawings) for transferring the photographic films from the cutting unit to the superimposing unit.

The terminal part of units 1,1' is formed by two respective guides 9, each defining a longitudinal groove bounded by two end flanges 9', 9''. Within each groove, there is an intermediate flange 10 which with the two end flanges defines two longitudinal cavities 11 and 12. The upper longitudinal cavity 11 represents substantially an extension of the transfer path of the photographic film pieces, whereas the lower longitudinal cavity 12 is at a level below the transfer path.

Each intermediate flange 10 can yield outwards, and for this purpose it is mounted on pairs of arms 13 pivoted on longitudinal shafts 14 disposed in a position below said arms 13.

To each arm 10 there is welded an outwardly projecting bar 15 to which an arm 16 supporting a roller 17 is pivotally connected, the arm being able to rotate freely between two extreme positions, in one of which (see FIG. 1) the arm is horizontal and the roller 17 is closer to the roller of the opposite flange, whereas in the other suggested by broken lines in FIG. 2, the arm is vertical with the roller 17 in its highest position.

With each roller 17 there is associated a shaped block 18 mounted on a vertical rod 19 which, together with another identical rod, is fixed to a support piece 20 comprising an inner opening, within this opening there is an eccentric cam 21 the shaft 22 of which is common to an identical cam on the other side of the device, and is connected to an electric motor 30.

The shaft 22 is splined so that its engagement with the cams 21 is such as to enable these to move longitudinally but not to rotate thereon.

The shaft 22 is supported by the overall frame of the device, the rods 19 also being supported by this frame but in a manner axially mobile thereto.

To the two rods 19 on each side of the device there is applied a L-section 23 having one vertical flange which extends parallel and adjacent to the corresponding terminal part 9 of the guide for the piece 29.

A longitudinal pusher 24 is provided in the zone between the two guide parts 9. It is rigid with a trolley 25 fixed to a belt 26 extending about two pulleys (not shown). An electric motor drives said trolley 25 between the two pulleys.

The plane along which said pusher 24 slides is at the same level as the two lower longitudinal cavities 12.

The device according to the invention also comprises a plurality of sensors, servomechanisms, control devices and generally everything required to automatically effect the operating cycle. These elements, which are apparent to the skilled man, do not in themselves constitute part of the invention, and are referred to in the course of the following description of operation as the opportunity arises.

The operation of the device according to the invention will for brevity be described commencing from a precise moment thereof, and on the assumption that the device is already set for handling photographic film of a certain width.

This initial moment will be taken as that in which a pack of stacked film pieces has just been discharged from the stacking unit, and the assembly is ready for forming a new pack.

Setting the device for handling film of a certain width can be done manually by adjusting the distance of the mobile longitudinal unit 1' from the fixed longitudinal unit 1, or alternatively, as in the illustrated case which is more convenient, by suitably powering the electric motor 3 so that it rotates the screw 4 which, engaged in the lead nut 5, moves the mobile unit 1' of the device along the transverse guides 2 until it is at the correct distance from the fixed unit 1.

The motor 3 is preferably controlled by a computer which has previously received a signal deriving from reading a suitable mark present on the film to be handled and on the basis of this signal has caused said motor 3 to move the mobile unit 1' to the correct distance from the fixed unit 1.

The configuration at the moment defined as the initial moment is one in which the flanges 10 are maintained in a projecting position in the two terminal parts 9 of the guide by the two arms 13, the two pairs of vertical rods 19 are in their upper end-of-travel positions analogously with the two L-shaped pushers 23, and the longitudinal pusher 24 is in its rear end-of-travel position (upstream).

Starting from that moment, after a length of film corresponding to one piece 29 has passed below the cutter, this is operated to separate the piece from the continuous film and allows it, engaged between the conveyor belts, to advance as far as the terminal parts 9, guided between, the two upper longitudinal cavities 11. The position of the front end of the piece 29 is determined by limit stops provided on both the two longitudinal cavities 11, but not shown on the drawings.

After a photoelectric cell has detected the presence of the piece at rest on the two guide parts 9, the electric motor 30 connected to the shaft 22 is automatically operated to rotate said shaft through 360°. As a result of this rotation the two cams 21 keyed onto it cause the corresponding support pieces 20 and the pair of rods 19 fixed to them to undergo a downward movement followed by an upward movement.

During the initial stage of the downward movement of said rods 19, each shaped block 18 encounters during its travel the corresponding roller 17, and as it cannot lower it because of the rigid reaction presented by its arm 16, it moves it outwards by the action of its shaped profile. This outward movement results in an analogous outward movement of the corresponding flange 10, which retracts into the part 9, so that the lower support for the piece 29 is now lacking and it falls until it rests on the lower flange of the parts 9. In the meantime the movement of the rods 19 has caused the two L-sections 23 to descend to follow the fall of the piece 29 and retain it in its newly reached position, and prevent it among other things from curving, which it tends to do.

When the two shaped blocks 18 have reached their lower end-of-travel position (see FIG. 2), they are because of their short vertical length already disengaged from the rollers 17 and thus allow the two intermediate flanges 10 to return to their initial projecting position by the effect of springs, not shown on the drawings. The successive return travel of the rods 19 causes both the shaped blocks 18 and the L-sections 23 to return to their upper end-of-travel position, during this stage the former again encountering the rollers along their path to move them outwards and upwards, this movement being allowed by the linkage system between the arms 16 and the bars 15.

When the rods 19 reach their upper end-of-travel position, the blocks 18 have passed beyond the rollers 17 and these, no longer under thrust, return to their initial position with their arms horizontal ready for the next cycle, which commences with the cutting of a new piece 29.

When this new piece is located between the two parts 9, a sequence of operations identical to that just described takes place to cause the new piece to fall onto the preceding, and so on until a pack comprising all the pieces of that order is obtained.

When this order is completed, an automatic command is fed to the motor to cause the longitudinal pusher 24 to advance through a distance such as to transfer the pack of pieces 29 downstream of said terminal guide parts 9 for subsequent handling, and after this outward travel cause it to return to its initial position ready to repeat the operation on the next pack of pieces when formed.

From the aforegoing it is apparent that the device of the present invention has numerous advantages over known machines for the same purpose, and in particular:

there is no risk of the film jamming during its transportation, even if accentuated arching of the pieces occurs, it does not cause the film to undergo any deformation during the superposing stage, and is therefore insensitive to any non-uniformity and transverse yieldability of the pieces, and it does not damage the surfaces of the film.

I claim:

1. A device for stacking pieces of strip material comprising a pair of guides for supporting opposite edges of the strip material, each guide comprising at least two parallel flanges defining at least one horizontal channel for the strip material, one of said flanges of each guide being horizontally displaceable with respect to a flange above it, to release a piece of said strip material from the channel, permitting it to fall into an underlying stacking magazine, and then returnable to its initial position to reconstitute the horizontal channel for a subsequent piece, at least one vertically acting pusher, operatively associated with said guides, for retaining the pieces in said magazine when said lower flange is in its horizontally displaced position, and a horizontally acting pusher for transferring a stack of pieces out of said stacking magazine.

2. The invention of claim 1, wherein each of the guides comprises a body having fixed upper and lower parallel flanges and an intermediate flange retractable into said body and arranged to define, when in its projecting position, an upper cavity for receiving individual pieces of strip material, and a lower cavity which constitutes said stacking magazine for the pieces.

3. The invention of claim 2, wherein said vertical pusher comprises a pair of angle section members, each having a vertical flange extending parallel to and facing a respective one of said guides.

4. The invention of claim 2, further comprising a supporting unit, and a pair of arms pivotally connected to said unit, each of said intermediate flanges being disposed at a distal end of a respective one of said arms, said arms being pivotable between an extended position, in which the intermediate flange projects between said fixed flanges, and a retracted position in which it does not.

5. The invention of claim 2, wherein the horizontal pusher is positioned at the level of said lower cavities.

6. The invention of claim 5, further comprising means for driving said horizontal pusher, said driving means comprising a pair of pulleys, means for driving at least one of said pulleys, and a belt extending around said pulleys, said pusher being mounted upon said belt.

7. The invention of claim 1, further comprising a pair of axially movable, vertical actuating rods, and a pair of bars, one bar being affixed to each of said intermediate flanges, each bar being linked by a cam and follower to a respective one of said actuating rods, and further comprising means connecting each of said rods to said vertical pusher, in such a way as to synchronize vertical movement of the vertical pusher with horizontal movement of said intermediate flanges.

8. The invention of claim 7, further comprising a second pair of axially movable, vertical actuating rods, corresponding rods of said pair of rods being affixed to a common support driven by an eccentric rotary cam arranged to cause said rods to reciprocate vertically.

9. The invention of claim 1, wherein said device comprises two laterally spaced supporting units, at least one of which is mounted on transverse guides to be movable toward and away from the other, and further comprising a screw and lead nut mechanism, driven by an electric motor, for varying the spacing between said units.

* * * * *